US010802420B2

(12) United States Patent
Kim

(10) Patent No.: US 10,802,420 B2
(45) Date of Patent: Oct. 13, 2020

(54) DEVELOPMENT CARTRIDGE HAVING SEALING MEMBER

(71) Applicant: Hewlett-Packard Development Company, L.P., Spring, TX (US)

(72) Inventor: Jong In Kim, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/478,285

(22) PCT Filed: Jan. 17, 2018

(86) PCT No.: PCT/KR2018/000773
§ 371 (c)(1),
(2) Date: Jul. 16, 2019

(87) PCT Pub. No.: WO2018/135846
PCT Pub. Date: Jul. 26, 2018

(65) Prior Publication Data

US 2019/0361372 A1 Nov. 28, 2019

(30) Foreign Application Priority Data

Jan. 19, 2017 (KR) ..... 10-2017-0009343

(51) Int. Cl.
*G03G 15/08* (2006.01)
*G03G 21/12* (2006.01)
*G03G 21/00* (2006.01)

(52) U.S. Cl.
CPC ..... *G03G 15/0881* (2013.01); *G03G 21/0011* (2013.01); *G03G 21/12* (2013.01)

(58) Field of Classification Search
CPC ..... G03G 15/0881; G03G 21/0011; G03G 21/12; G03G 21/1814; G03G 21/1828
See application file for complete search history.

(56) References Cited

U.S. PATENT DOCUMENTS 6,185,393 B1 2/2001 Karakama et al.
6,658,223 B2 * 12/2003 Nishimura ..... G03G 21/007 399/102

(Continued)

FOREIGN PATENT DOCUMENTS

JP H09006212 A 1/1997
JP 2000131926 A 5/2000

(Continued)

*Primary Examiner* — Hoang X Ngo
(74) *Attorney, Agent, or Firm* — Jefferson IP Law, LLP

(57) ABSTRACT

Disclosed is a development cartridge detachable from a main body of an image forming apparatus. The development cartridge includes a lateral waste toner sealing member contacting an end portion of a photosensitive drum in a lengthwise direction of the photosensitive drum to prevent a waste toner from leaking through the end portion of the photosensitive drum, and a photosensitive frame including a waste toner container to contain the waste toner, a first attachment surface, to which the lateral waste toner sealing member is attached, and a side wall to form a boundary at an upstream side of the first attachment surface with respect to a rotation direction of the photosensitive drum. The lateral waste toner sealing member includes an opposite surface facing the side wall, and a protrusion protruding towards the side wall is provided on the opposite surface.

10 Claims, 10 Drawing Sheets

(56) References Cited

U.S. PATENT DOCUMENTS

| | | | |
|---|---|---|---|
| 9,280,135 | B2 | 3/2016 | Nonaka |
| 2003/0118364 | A1 | 6/2003 | Kamimura |
| 2006/0251445 | A1 | 11/2006 | Ueno et al. |
| 2009/0274482 | A1 | 11/2009 | Xu et al. |
| 2013/0084098 | A1 | 4/2013 | Kanazawa et al. |
| 2014/0086618 | A1 | 3/2014 | Shimizu et al. |
| 2014/0093270 | A1 | 4/2014 | Nonaka |
| 2016/0070203 | A1* | 3/2016 | Kitamura ..... G03G 15/0817 399/103 |

FOREIGN PATENT DOCUMENTS

| | | | |
|---|---|---|---|
| JP | 2003228235 | A | 8/2003 |
| JP | 2004-37637 | A | 2/2004 |
| JP | 2013134355 | A | 7/2013 |
| JP | 2014056176 | A | 3/2014 |
| JP | 2015125380 | A | 7/2015 |
| WO | WO-2013142799 | A1 | 9/2013 |

* cited by examiner

[Fig. 1]
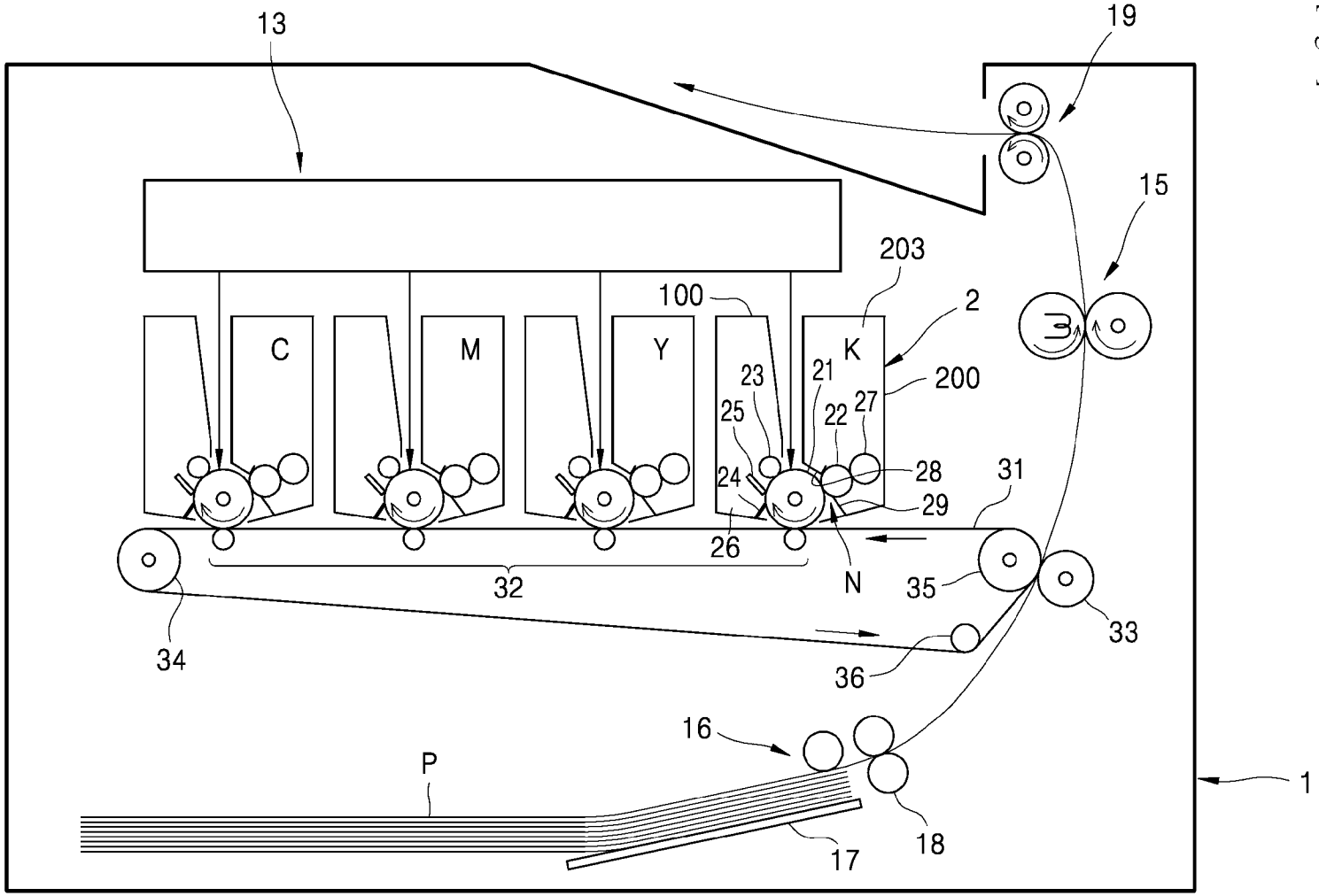

[Fig. 2]
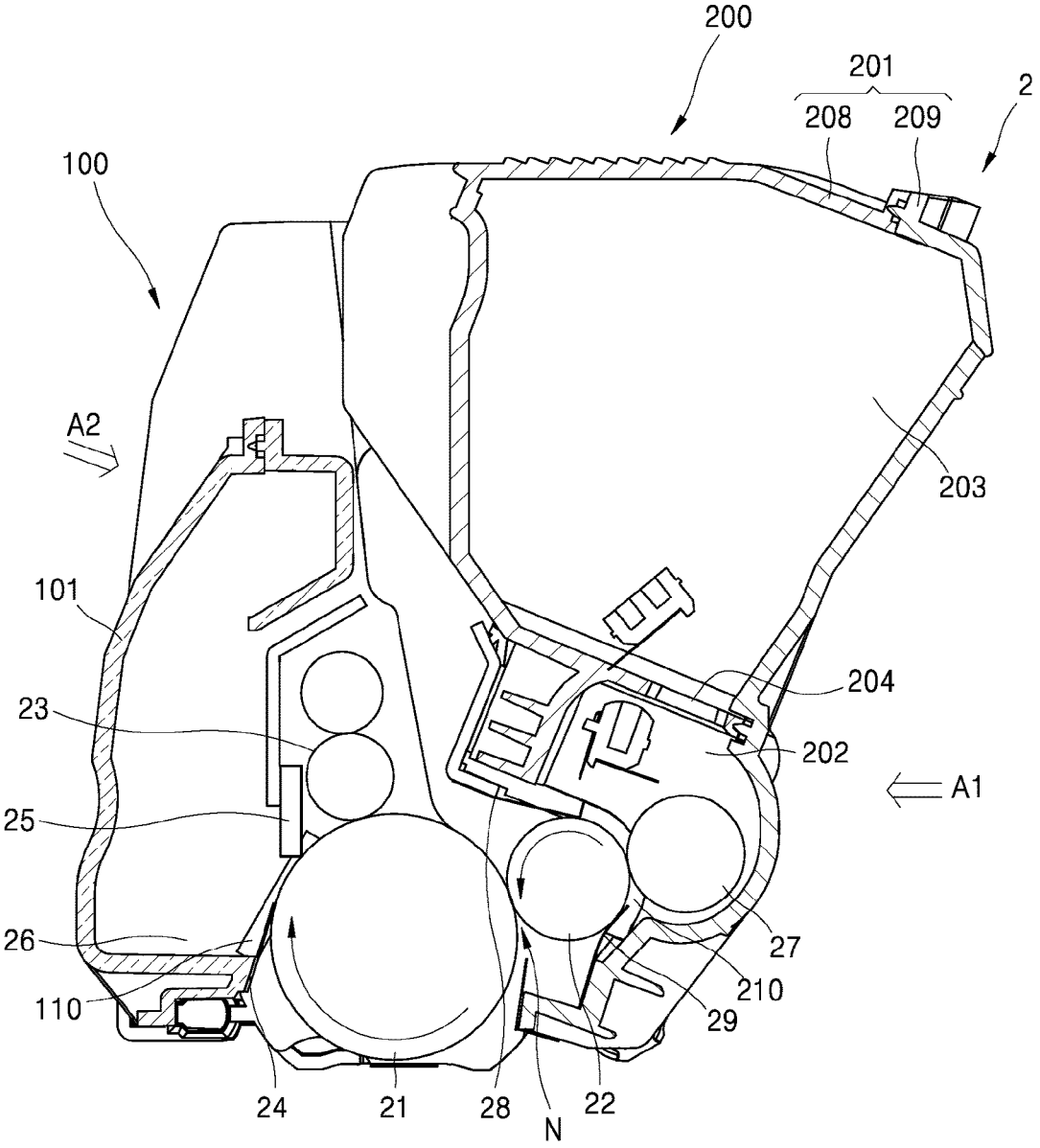

[Fig. 3]
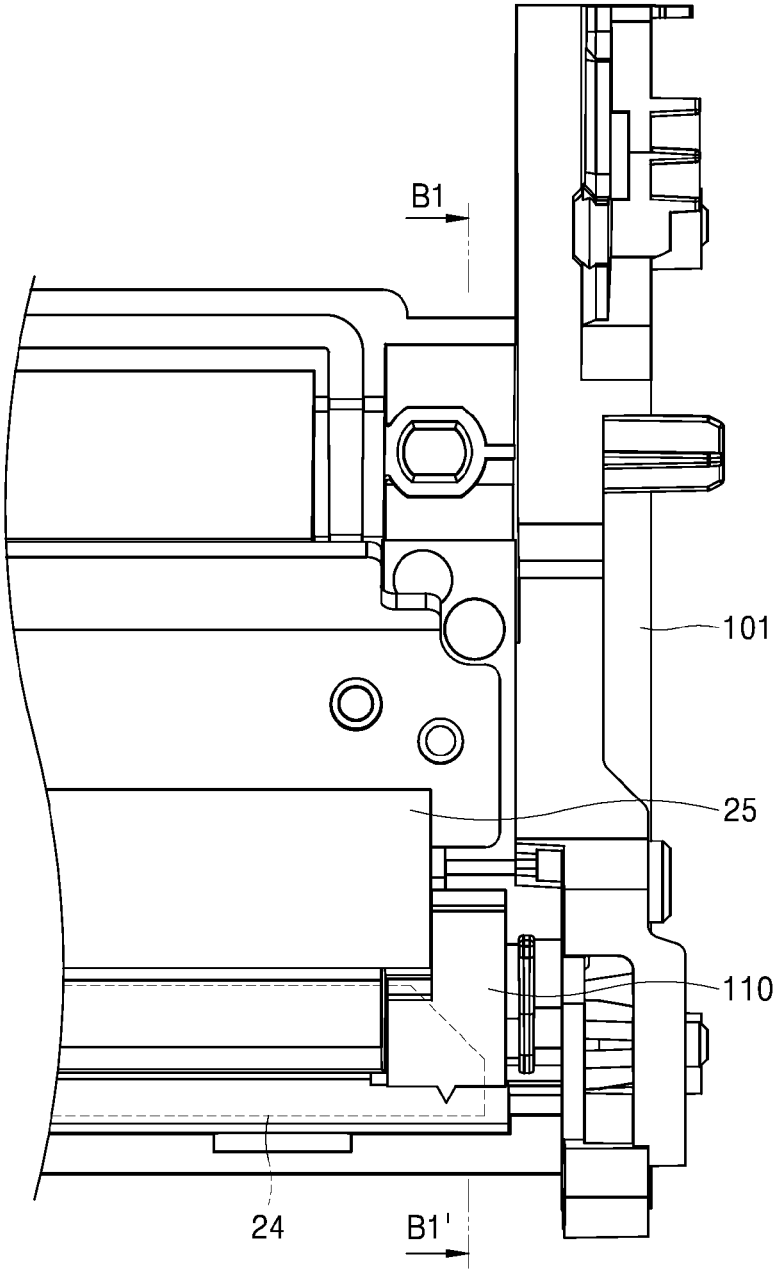

[Fig. 4]
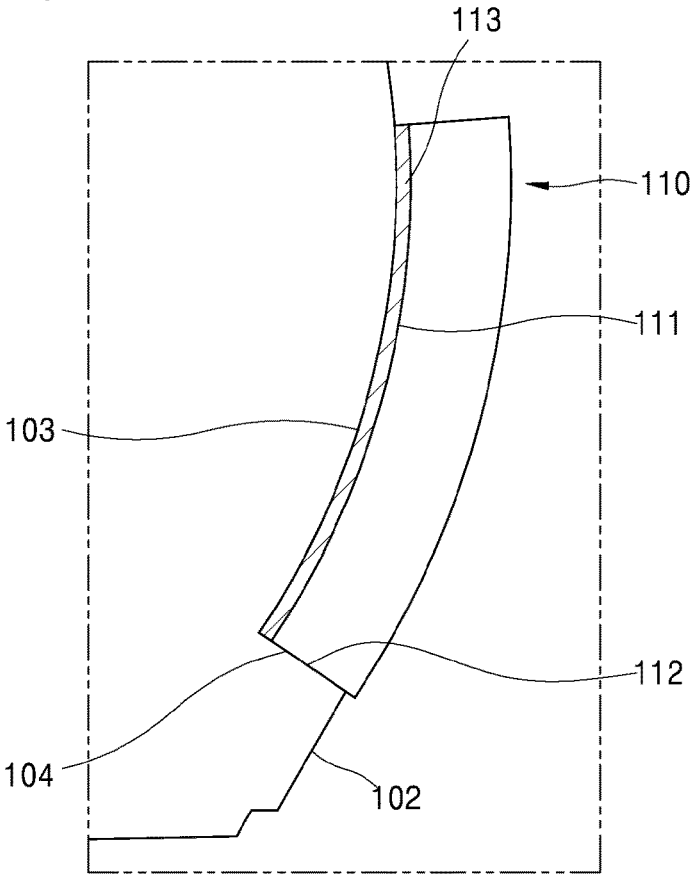
[Fig. 5a]
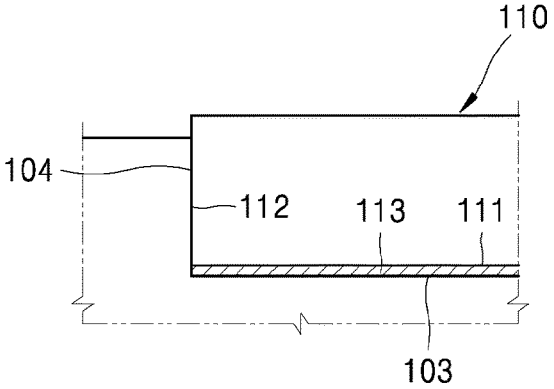
[Fig. 5b]
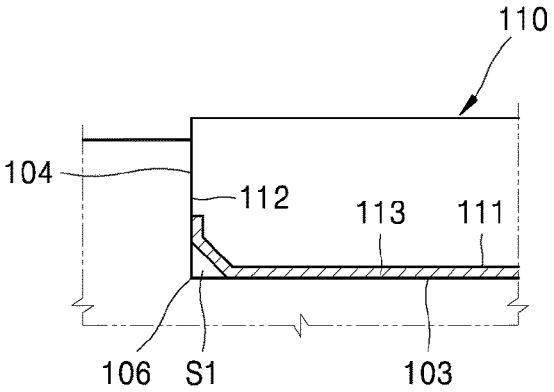

[Fig. 5c]
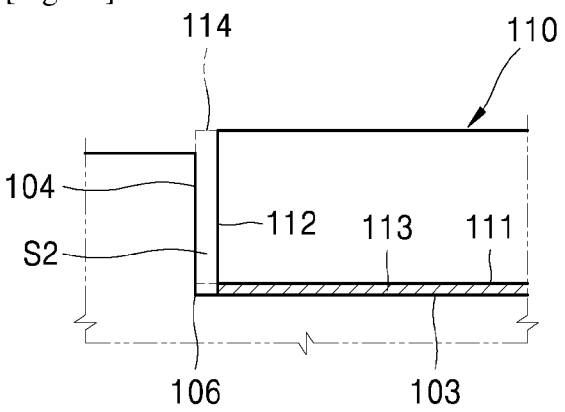
[Fig. 6a]
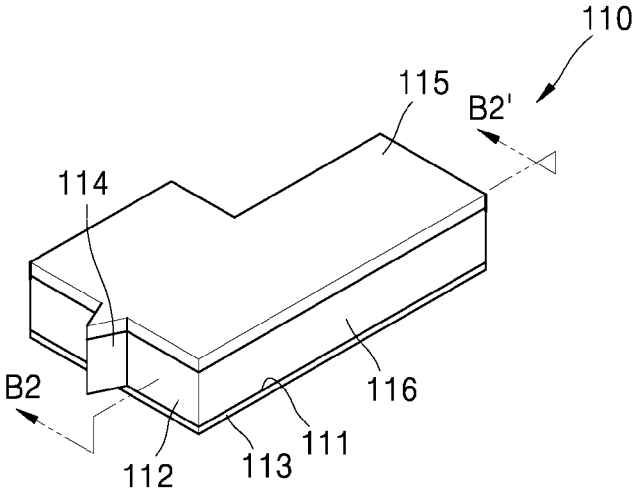
[Fig. 6b]
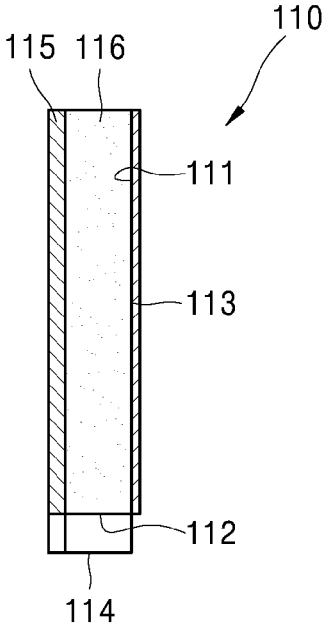

[Fig. 7a]
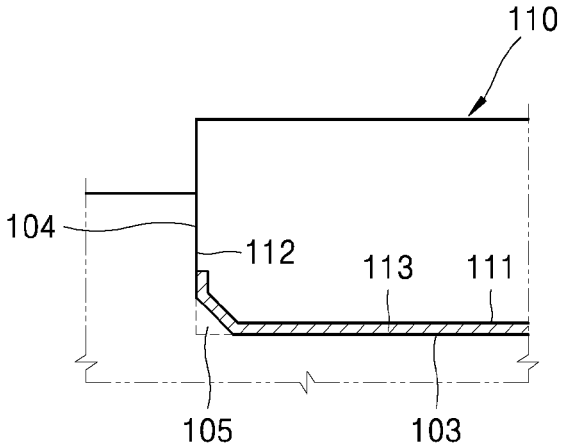
[Fig. 7b]
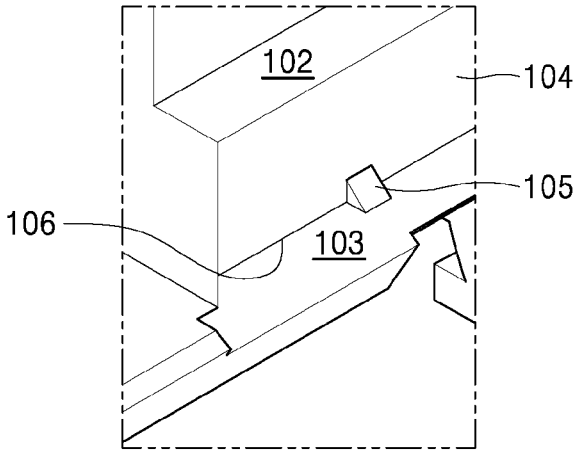

[Fig. 8]
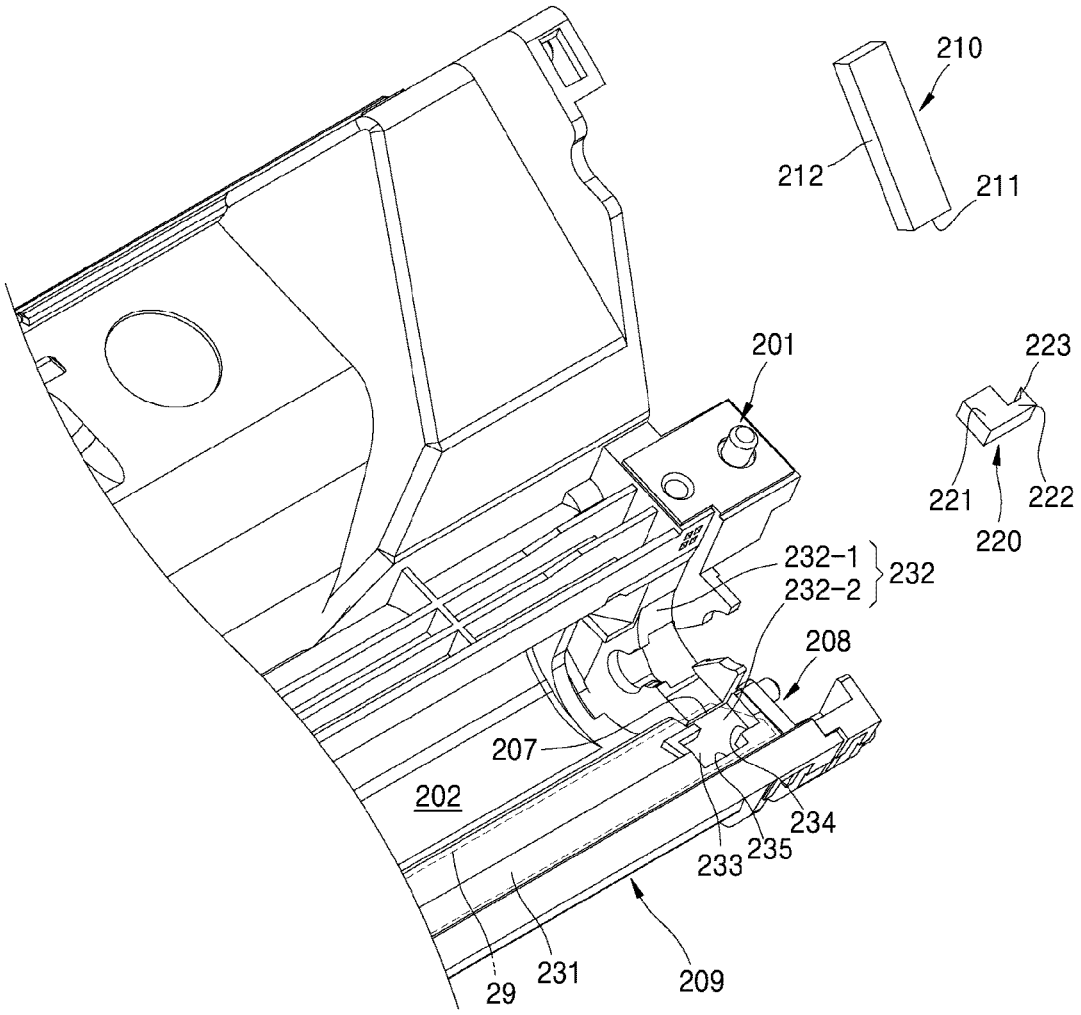

[Fig. 9]
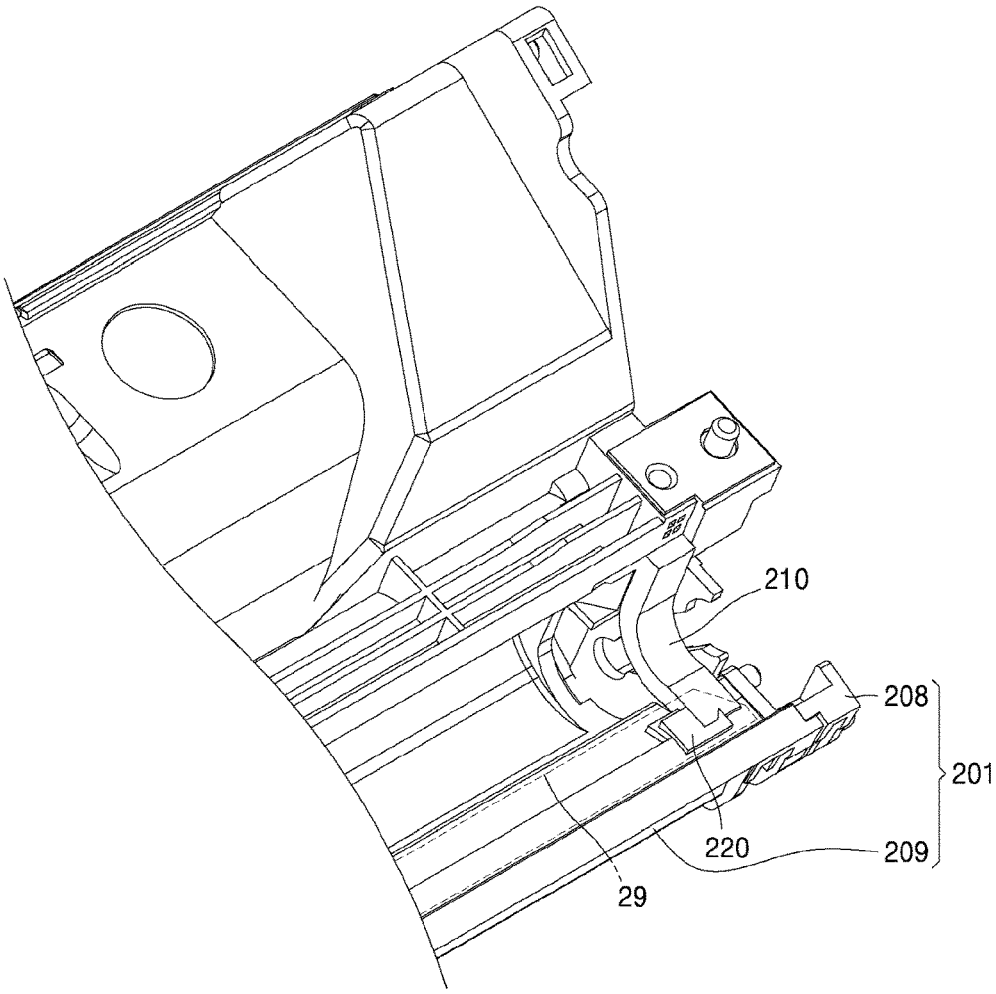
[Fig. 10a]
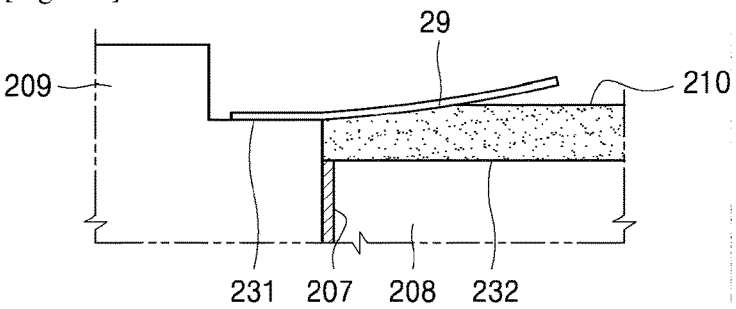
[Fig. 10b]
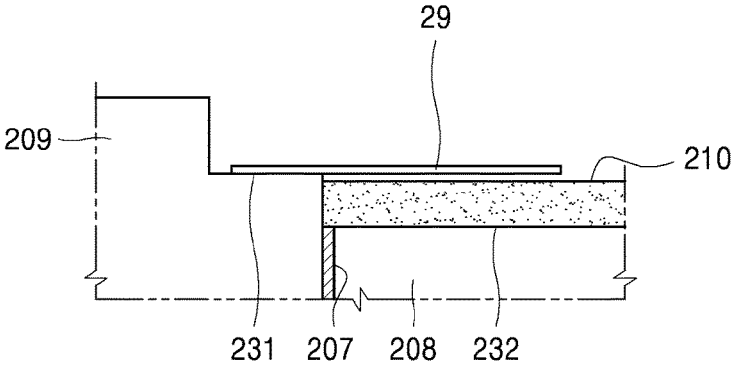

[Fig. 11]
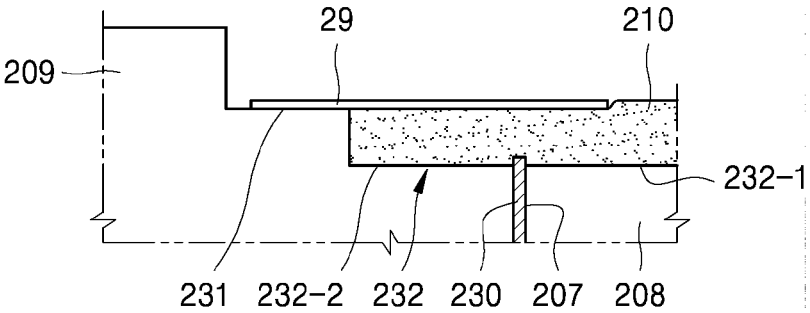
[Fig. 12]
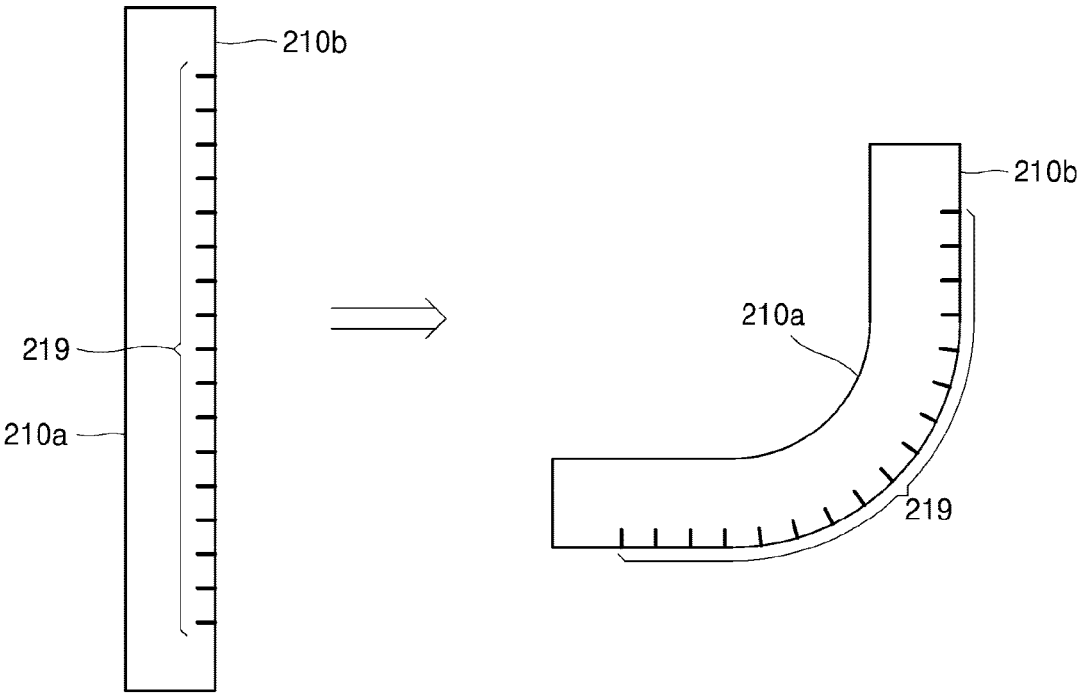

[Fig. 13]
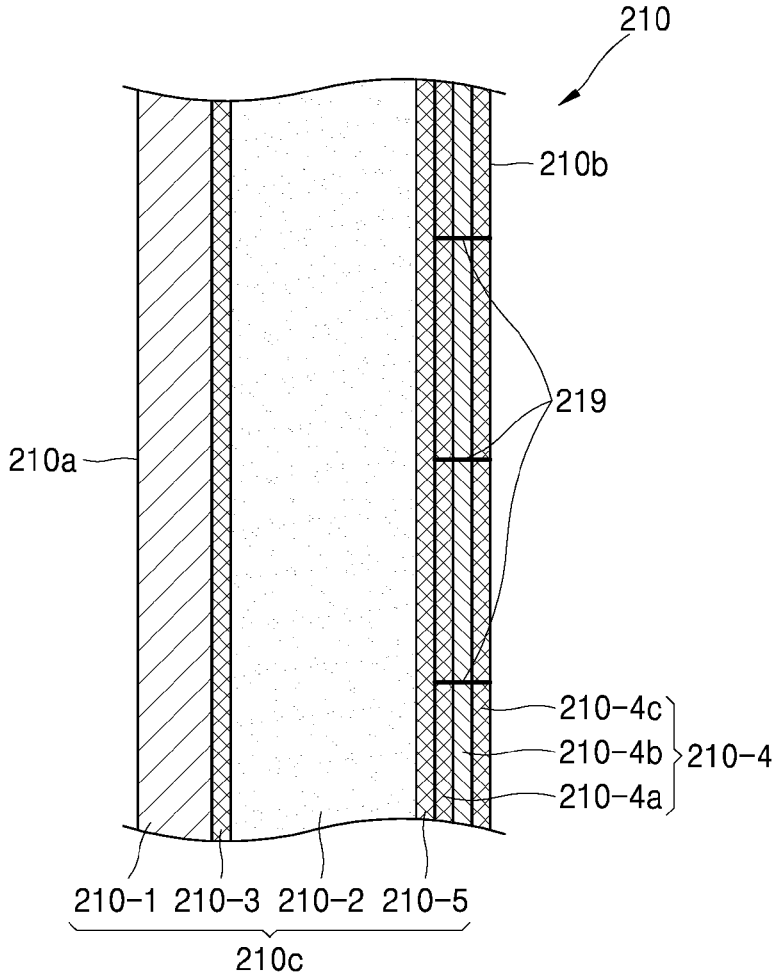

DEVELOPMENT CARTRIDGE HAVING SEALING MEMBER

BACKGROUND ART

An image forming apparatus using electrophotography forms a visible toner image on a photoconductor by supplying a toner to an electrostatic latent image formed on the photoconductor, transfers the toner image onto a recording medium, and fixes the transferred toner image on the recording medium, thereby printing an image on the recording medium. A developing unit contains a toner (developer) and includes a developing roller for supplying the toner to the electrostatic latent image formed on the photoconductor.

A development cartridge is an assembly of components for forming a visible toner image. The development cartridge is detachable from a main body of the image forming apparatus and is a consumable replaced when the development cartridge is used up. The development cartridge includes a housing and a plurality of rotation members, e.g., a photosensitive drum, a developing roller, and the like, which are installed in the housing. The housing contains a toner. When the toner leaks from the housing, the inside of the image forming apparatus is contaminated. Therefore, the development cartridge includes a sealing structure to prevent the toner from leaking from the housing.

DISCLOSURE OF INVENTION

Brief Description of Drawings

These and/or other aspects will become apparent and more readily appreciated from the following description of the examples, taken in conjunction with the accompanying drawings in which:

FIG. 1 is a schematic structural view of an electrophotographic image forming apparatus according to an example;

FIG. 2 is a schematic cross-sectional view of a development cartridge according to an example;

FIG. 3 is a diagram of a photosensitive frame viewed in a direction A1 of FIG. 2 according to an example;

FIG. 4 is a cross-sectional view taken along a line B1-B1' of FIG. 3 according to an example;

FIGS. 5*a* to 5*c* are diagrams illustrating attachment states of a lateral waste toner sealing member according to examples;

FIG. 6*a* is a perspective view of a lateral waste toner sealing member according to an example;

FIG. 6*b* is a cross-sectional view taken along a line B2-B2' of FIG. 6A according to an example;

FIG. 7*a* is a cross-sectional view illustrating an example of shapes of a side wall and a first attaching surface for sealing;

FIG. 7*b* is a schematic perspective view of FIG. 7*a* according to an example;

FIG. 8 is an exploded perspective view of an example of a sealing structure for preventing a toner from leaking in a lengthwise direction of a developing roller;

FIG. 9 is a perspective view of an example of a sealing structure for preventing a toner from leaking in a lengthwise direction of a developing roller;

FIGS. 10*a* and 10*b* are diagrams illustrating contact states of a lower sealing member and a first lateral sealing member, according to a coupling state of an upper frame and a lower frame, according to an example;

FIG. 11 is a diagram illustrating a contact state of a lower sealing member and a first lateral sealing member according to an example;

FIG. 12 is a side view of a first lateral sealing member according to an example; and FIG. 13 is a cross-sectional view of the first lateral sealing member of FIG. 12 according to an example.

MODE FOR THE INVENTION

Reference will now be made to examples, which are illustrated in the accompanying drawings, wherein like reference numerals refer to like elements throughout. In this regard, the present examples may have different forms and should not be construed as being limited to the descriptions set forth herein. Accordingly, the examples are described below, by referring to the figures, to explain aspects. As used herein, the term "and/or" includes any and all combinations of one or more of the associated listed items.

FIG. 1 is a schematic structural view of an electrophotographic image forming apparatus according to an example. The electrophotographic image forming apparatus according to the present example prints color images on a recording medium P by using electrophotography.

Referring to FIG. 1, the image forming apparatus may include a main body 1 and development cartridges 2. The development cartridges 2 may be detachable from the main body 1. The main body 1 includes an exposure device 13, a transfer device, and a fixing device 15. Also, the main body 1 includes a recording medium transfer unit for loading and transferring the recording medium P on which an image is to be formed.

For color printing, the development cartridges 2 may include four development cartridges 2 for developing, for example, cyan (C), magenta (M), yellow (Y), and black (K) images. The development cartridges 2 may respectively include C, M, Y, and K developers, for example, toners. Although not illustrated in the drawings, the C, M, Y, and K toners may be respectively included in four toner supply containers and may be respectively supplied to the four development cartridges 2 from the four toner supply containers. The image forming apparatus may further include development cartridges 2 for containing and developing toners of various colors such as light magenta and white in addition to the above-described colors. Hereinafter, the image forming apparatus including the four development cartridges 2 will be described, and unless clearly indicated otherwise, C, M, Y, and K following reference numerals denote elements for developing cyan, magenta, yellow, and black images.

The development cartridges 2 are of integral types. Development cartridges 2C, 2M, 2Y, and 2K may be detachable from the main body 1 through doors that are not illustrated in the drawings.

FIG. 2 is a schematic cross-sectional view of a development cartridge according to an example.

Referring to FIG. 2, the development cartridge 2 may include a photosensitive unit 100 and a developing unit 200.

The photosensitive unit 100 includes a photosensitive drum 21. The photosensitive drum 21 is an example of a photoconductor for forming an electrostatic latent image on the surface thereof, and may include a conductive metal pipe and a photosensitive layer provided on an outer circumferential surface of the conductive metal pipe. A charging roller 23 is an example of a charger for charging the photosensitive drum 21 to have a uniform surface potential. A charging brush, a corona charger, or the like may be used instead of the charging roller 23. The photosensitive unit 100 may further include a cleaning roller (not shown) for removing a foreign material on a surface of the charging roller 23. A cleaning blade 25 is an example of a cleaning member for removing a foreign material and a toner remaining on the surface of the photosensitive drum 21 after a transfer process to be described below. Another type of a cleaning member, e.g., a rotating brush, may be used instead of the cleaning blade 25. Hereinafter, the toner and foreign material removed from the photosensitive drum 21 by the cleaning blade 25 will be referred to as a waste toner. The waste toner may be removed to and stored in a waste toner container 26.

The developing unit 200 includes a toner container 203. The developing unit 200 supplies the toner in the toner container 203 to an electrostatic latent image formed on the photosensitive drum 21, thereby developing the electrostatic latent image into a toner image. A development scheme includes a one-component development scheme for using a toner and a two-component development scheme for using a toner and a carrier. The development unit 200 employs a one-component development scheme. A developing roller 22 is used to supply the toner to the photosensitive drum 21. A developing bias voltage for supplying the toner to the photosensitive drum 21 may be applied to the developing roller 22.

In the present example, a contact development scheme is used in which the developing roller 22 and the photosensitive drum 21 contact each other and thus form a development nip N. A supply roller 27 supplies the toner in the toner container 203 to a surface of the developing roller 22. To this end, a supply bias voltage may be applied to the supply roller 27. The developing unit 200 may further include a regulator 28 for regulating an amount of toner supplied by the developing roller 22 to the development nip N where the photosensitive drum 21 and the developing roller 22 contact each other. The regulator 28 may be a blade that elastically contacts the surface of the developing roller 22. On an opposite side, in other words, a downstream side of the regulator 28, with respect to a rotation direction of the developing roller 22, the developing unit 200 may further include a lower sealing member 29 that contacts the developing roller 22 and to prevent the toner from leaking. The lower sealing member 29 may be, for example, a film contacting the developing roller 22.

The exposure device 13 irradiates light, which is modulated according to image information, onto the photosensitive drum 21 and forms an electrostatic latent image on the photosensitive drum 21. Examples of the exposure device 13 may include a laser scanning unit (LSU) using a laser diode as a light source, a light-emitting diode (LED) exposure device using an LED as a light source, etc.

The transfer device may include an intermediate transfer belt 31, a first transfer roller 32, and a second transfer roller 33. A toner image developed on the photosensitive drum 21 of each of the development cartridges 2C, 2M, 2Y, and 2K is temporarily transferred to the intermediate transfer belt 31. The intermediate transfer belt 31 is circularly driven while being supported by supporting rollers 34, 35, and 36. Four first transfer rollers 32 are provided to face the photosensitive drums 21 of the development cartridges 2C, 2M, 2Y, and 2K with the intermediate transfer belt 31 therebetween. A first transfer bias voltage is applied to the first transfer roller 32 so as to firstly transfer the toner image, which is developed on the photosensitive drum 21, to the intermediate transfer belt 31. Instead of the first transfer roller 32, corona transfer devices or pinscorotron transfer devices may be used. The second transfer roller 33 is located to face the intermediate transfer belt 31. A second transfer bias voltage is applied to the second transfer roller 33 so as to transfer, to the recording medium P, the toner images firstly transferred to the intermediate transfer belt 31.

When a print command is transmitted from a host (not shown) or the like, a controller (not shown) uses the charging roller 23 to charge the surface of the photosensitive drum 21 at a uniform potential. The exposure device 13 scans the photosensitive drums 21 of the development cartridges 2C, 2M, 2Y, and 2K with four light beams respectively modulated according to image information regarding four colors, that is, cyan, magenta, yellow, and black, thereby forming electrostatic latent images on the photosensitive drums 21. The developing rollers 22 of the development cartridges 2C, 2M, 2Y, and 2K supply C, M, Y, and K toners respectively to the corresponding photosensitive drums 21 and develop the electrostatic latent images into visible toner images. The developed toner images are firstly transferred to the intermediate transfer belt 31. The recording medium P loaded on a loading table 17 is output one-by-one by a pick-up roller 16, and is transported by a feed roller 18 to a transfer nip formed by the second transfer roller 33 and the intermediate transfer belt 31. The toner images that are firstly transferred to the intermediate transfer belt 31 are secondarily transferred to the recording medium P due to the second transfer bias voltage applied to the second transfer roller 33. When the recording medium P passes through the fixing device 15, the toner images are fixed on the recording medium P due to heat and pressure. The recording medium P, on which the toner images are fixed, is discharged outside by a discharge roller 19.

Referring to FIG. 2, the photosensitive unit 100 includes a photosensitive frame 101.

FIG. 3 is a diagram of a photosensitive frame that is viewed in a direction A1 of FIG. 2 according to an example.

Referring to FIGS. 2 and 3, the photosensitive drum 21, the charging roller 23, the cleaning blade 25, a lower waste toner sealing member 24, and a lateral waste toner sealing member 110 are supported by the photosensitive frame 101.

The cleaning blade 25 extends in a lengthwise direction of the photosensitive drum 21, and an end portion of the cleaning blade 25 contacts the surface of the photosensitive drum 21 and removes the waste toner remaining on the surface of the photosensitive drum 21 after a transfer process. The waste toner is contained in the waste toner container 26 included in the photosensitive frame 101.

On an opposite side of the cleaning blade 25, in other words, on an upstream side of the cleaning blade 25, with respect to the rotation direction of the photosensitive drum 21, the lower waste toner sealing member 24 contacts the photosensitive drum 21 to prevent the waste toner from leaking. The lower waste toner sealing member 24 may be, for example, a film contacting the photosensitive drum 21. The lower waste toner sealing member 24 extends in the lengthwise direction of the photosensitive drum 21 and contacts the surface of the photosensitive drum 21.

In order to prevent the waste toner from leaking through an end portion of the photosensitive drum 21 in the lengthwise direction, the lateral waste toner sealing member 110 is provided. The lateral waste toner sealing member 110 is installed in the photosensitive frame 101 to contact the end portion of the photosensitive drum 21 in the lengthwise direction. FIG. 3 illustrates one lateral waste toner sealing member 110, but a pair of lateral waste toner sealing members 110 may be installed in the photosensitive frame 101 so that the lateral waste toner sealing members 110 respectively contact both end portions of the photosensitive drum 21 in the lengthwise direction.

A region where the lateral waste toner sealing member 110 contacts the photosensitive drum 21 includes a region between a portion contacting the end portion of the cleaning blade 25 and a portion contacting the lower waste toner sealing member 24, in a circumferential direction of the photosensitive drum 21. The lateral waste toner sealing member 110 overlaps the cleaning blade 25 and the lower waste toner sealing member 24. The waste toner container 26 is sealed by the cleaning blade 25, the lower waste toner sealing member 24, and the lateral waste toner sealing member 110.

The lateral waste toner sealing member 110 may be attached to the photosensitive frame 101.

FIG. 4 is a cross-sectional view taken along a line B1-B1' of FIG. 3 according to an example.

Referring to FIG. 4, the photosensitive frame 101 includes a second attachment surface 102, to which the lower waste toner sealing member 24 is attached, and a first attachment surface 103, to which the lateral waste toner sealing member 110 is attached. The first attachment surface 103 has a concave step from the second attachment surface 102. A side wall 104 forms a boundary between the second attachment surface 102 and the first attachment surface 103. The side wall 104 extends in the lengthwise direction of the photosensitive drum 21. Relative to the rotation direction of the photosensitive drum 21, the second attachment surface 102 is located on an upstream side of the first attachment surface 103. Therefore, relative to the rotation direction of the photosensitive drum 21, the side wall 104 is located on the upstream side of the first attachment surface 103 and forms an upstream side boundary of the first attachment surface 103.

On a bottom surface 111 of the lateral waste toner sealing member 110, an adhesive layer 113 for attaching the lateral waste toner sealing member 110 to the first attachment surface 103 is provided. The adhesive layer 113 may be provided by, for example, double-sided tape.

FIGS. 5*a* to 5*c* are diagrams illustrating attachment states of a lateral waste toner sealing member according to an example.

Referring to FIG. 5*a* to 5*c*, the side wall 104 and an opposite surface 112 of the lateral waste toner sealing member 110 which faces the side wall 104 have to adhere to each other, as illustrated in FIG. 5*a*. When the lateral waste toner sealing member 110 is attached to the first attachment surface 103, as illustrated in FIG. 5*b*, if the adhesive layer 113 is attached to the side wall 104, the adhesive layer 113 may be partially attached to the side wall 104, and thus a deformity (e.g., a crack) S1 may be formed in an edge portion 106 where the side wall 104 contacts the first attachment surface 103. Also, when the adhesive layer 113 is improperly attached to the first attachment surface 103, a deformity (e.g., a crack) S2 may be formed between the side wall 104 and the opposite surface 112, as illustrated in FIG. 5*c*.

As described above, a process of attaching the lateral waste toner sealing member 110 to the photosensitive frame 101 requires high proficiency of workers and high accuracy of equipment for attaching the lateral waste toner sealing member 110 to the photosensitive frame 101, and it is difficult to secure sealing safety of the waste toner container 26. Thus, a structure for improving the sealing safety of the waste toner container 26 is necessary.

For example, a sealing structure may be embodied by a shape of the lateral waste toner sealing member 110.

FIG. 6*a* is a perspective view of a lateral waste toner sealing member according to an example, and FIG. 6*b* is a cross-sectional view taken along a line B2-B2' of FIG. 6*a* according to an example.

Referring to FIGS. 6*a* and 6*b*, the lateral waste toner sealing member 110 includes a protrusion 114 protruding from the opposite surface 112. The protrusion 114 protrudes overall in a thickness direction of the lateral waste toner sealing member 110, but partially protrudes in a widthwise direction of the lateral waste toner sealing member 110, that is, the lengthwise direction of the photosensitive drum 21. A degree to which the protrusion 114 protrudes from the opposite surface 112 may be appropriately determined by taking elasticity of the lateral waste toner sealing member 110 into account. For example, the degree to which the protrusion 114 protrudes from the opposite surface 112 may be less than or equal to about 1.5 mm. The lateral waste toner sealing member 110 is attached to the first attachment surface 103 so that the protrusion 114 contacts the side wall 104 and is then pressed. In order to make the protrusion 114 contact the side wall 104 and be naturally pressed, the protrusion 114 is not attached to the first attachment surface 103. In other words, the adhesive layer 113 may be on a portion of the bottom surface 111 of the lateral waste toner sealing member 110, except for a portion corresponding to the protrusion 114.

Based on the above configuration, the protrusion 114 contacts the side wall 104 when the lateral waste toner sealing member 110 is attached to the first attachment surface 103, to prevent the deformity (S1 of FIG. 5*b*), formed as the adhesive layer 113 is attached to the side wall 104, from being formed. Also, although the opposite surface 112 of the lateral waste toner sealing member 110 is attached to the first attachment surface 103 to be slightly apart from the side wall 104, the protrusion 114 contacts the side wall 104, as illustrated in FIG. 5*c*, and thus the deformity S2 is not formed.

FIG. 6*a* illustrates the protrusion 114 having a triangle shape, but the shape is not limited thereto. The shape of the protrusion 114 may be rectangular, oval, or the like. Also, there may be two or more protrusions 114. The lateral waste toner sealing member 110 may have a double-layer structure including a felt layer 115 contacting an outer circumferential surface of the photosensitive drum 21, and an elastic layer 116 having elasticity.

For instance, the sealing structure may be embodied by the shapes of the first attachment surface 103 and the side wall 104.

FIG. 7*a* is a cross-sectional view illustrating an example of shapes of a side wall and a first attaching surface for sealing, and FIG. 7*b* is a schematic perspective view of FIG. 7*a* according to an example.

Referring to FIGS. 7*a* and 7*b*, on the edge portion 106 where the first attachment surface 103 contacts the side wall 104, a connection portion 105 for connecting the side wall 104 to the first attachment surface 103 is provided. A height of the connection portion 105 is less than that of the side wall 104. The connection portion 105 may obliquely connect the side wall 104 to the first attachment surface 103.

Based on the above configuration, as illustrated in FIG. 7*a*, although the adhesive layer 113 is attached to the side wall 104, part of the adhesive layer 113 is attached to the connection portion 105. Thus, the deformity (S1 of FIG. 5*c*) is blocked by the connection portion 105, and leakage of the waste toner through the deformity (S1 of FIG. 5*c*) may be prevented. A width of the connection portion 105 may be, for example, about 1 mm to about 3 mm. There may be one or at least two connection portions 105 along the side wall 104. The lateral waste toner sealing member 110 may or may not include the protrusion 114. When the lateral waste toner sealing member 110 including the protrusion 114 is used, the protrusion 114 may overlap the connection portion 105 or may not overlap the same. When the lateral waste toner sealing member 110 including the protrusion 114 is used, the deformity (S2 of FIG. 5*c*) between the side wall 104 and the opposite surface 112 may be blocked by the protrusion 114, and the deformity (S1 of FIG. 5*b*) in the edge portion 106, where the side wall 104 contacts the first attachment surface 103, may be blocked by the connection portion 105.

Based on the above configuration, the sealing safety of the waste toner container 26 may be improved.

The above examples regarding the structure for sealing the waste toner container 26 may be applied to a development cartridge to prevent powdered materials, e.g., a toner, from leaking through a side portion of a rotating member. In this case, the development cartridge includes the rotating member, a sealing member contacting an end portion of the rotating member in a lengthwise direction of the rotating member and sealing the end portion, a frame including a first attachment surface, to which the sealing member is attached, and a side wall forming a boundary of the first attachment surface. The sealing member includes an opposite surface facing the side wall, and a protrusion protruding towards the side wall is provided on the opposite surface. Here, the rotating member may be, for example, the developing roller 22, the charging roller 23, the supply roller 27, or the like.

Referring again to FIGS. 1 and 2, the developing unit 200 includes a development frame 201. The developing roller 22, the supply roller 27, the regulator 28, and the lower sealing member 29 are supported by the development frame 201. The development frame 201 includes the toner container 203 and a developing portion 202. The toner container 203 and the developing portion 202 are connected to each other via an opening 204. The toner in the toner container 203 is transported to the developing portion 202 via the opening 204. The developing roller 22, the supply roller 27, the regulator 28, and the lower sealing member 29 are installed in the developing portion 202. The developing portion 202 is open towards the photosensitive drum 21, and the developing roller 22 is installed in the open portion of the developing portion 202. A portion of an outer circumferential surface of the developing roller 22 is inside the developing portion 202, and another portion thereof is outside the developing portion 202. The toner in the developing portion 202 is attached to the outer circumferential surface of the developing roller 22, and as the developing roller 22 rotates, the toner is transported outside from the developing portion 202.

In an example, the regulator 28 is a metal blade having elasticity, and an end portion thereof contacts the outer circumferential surface of the developing roller 22. The lower sealing member 29 is an elastic film member and contacts the outer circumferential surface of the developing roller 22.

With respect to the rotation direction of the developing roller 22, the lower sealing member 29 is at a downstream side, compared to the regulator 28. That is, a region between a portion of the outer circumferential surface of the developing roller 22 which contacts the end portion of the regulator 28 and a portion contacting the lower sealing member 29 is exposed to the outside of the developing portion 202. Sealing the developing portion 202 in the rotation direction of the developing roller 22 may be realized by the regulator 28, the lower sealing member 29, and the outer circumferential surface of the developing roller 22, which is exposed to the outside of the developing portion 202. Although not illustrated in the drawings, at least one sealing member for preventing the leakage of the toner may be between the regulator 28 and the development frame 201.

An example of the sealing structure for preventing the leakage of the toner in the lengthwise direction of the developing roller 22 will now be described.

According to an example, the development cartridge 2 may further include a development frame including a development portion, a developing roller installed rotatably in the development frame to discharge a toner from the development portion, a first lateral sealing member attached to a first mounting surface of the development frame, contacting an end portion of the developing roller in a lengthwise direction thereof, to prevent leakage of the toner through the end portion of the developing roller, and a second lateral sealing member located on an inner portion of the first lateral sealing member in the lengthwise direction of the developing roller and having elasticity to prevent the leakage of the toner through a crack between a side wall, which forms a boundary on a side of the first mounting surface in the lengthwise direction, and an end portion of the first lateral sealing member facing the side wall. The second lateral sealing member may include a first portion located inside the first lateral sealing member and contacting an inner portion adjacent to the end portion of the first lateral sealing member, and a second portion extending from the first portion along the end portion of the first lateral sealing member, thus forming an "L" shape overall. The second lateral sealing member may further include a third portion protruding from the second portion towards the end portion of the first lateral sealing member.

In an example, the development cartridge 2 includes a development frame including a development portion, a developing roller installed rotatably in the development frame to discharge a toner from the development portion, and a first lateral sealing member attached to the development frame, contacting an end portion of the developing roller in a lengthwise direction of the developing roller, to prevent the toner from leaking through the end portion of the developing roller. The development frame may include upper and lower frames which are connected to each other and form the development portion. A first mounting surface to which the first lateral sealing member is attached may be over the upper and lower frames.

In an example, the development cartridge 2 includes a development frame including a development portion, a developing roller installed rotatably in the development frame to discharge a toner from the development portion, and a first lateral sealing member attached to the development frame, contacting an end portion of the developing roller in a lengthwise direction of the developing roller, to prevent the toner from leaking through the end portion of the developing roller. The first lateral sealing member may include a body having elasticity, a double-sided tape layer for attaching the body to the development frame, and a support layer between the body and the double-sided tape layer and having ductility. The double-sided tape layer may include a plurality of slits (e.g., cutting scars).

Hereinafter, the above examples will be described in sequence.

FIG. 8 is an exploded perspective view of an example of a sealing structure for preventing toner from leaking in a lengthwise direction of a developing roller, and FIG. 9 is a perspective view of an example of a sealing structure for preventing toner from leaking in a lengthwise direction of a developing roller.

Referring to FIGS. 8 and 9, the developing unit 200 includes a first lateral sealing member 210 and a second lateral sealing member 220. The first lateral sealing member 210 contacts the end portion of the developing roller 22 in the lengthwise direction of the developing roller 22. The first lateral sealing member 210 contacts a portion of the outer circumferential surface of the developing roller 22 which is inside the developing portion 202. The second lateral sealing member 220 is located inside the first lateral sealing member 210 in the lengthwise direction of the developing roller 22. The lower sealing member 29 overlaps the first lateral sealing member 210 and the second lateral sealing member 220. FIG. 8 illustrates one first lateral sealing member 210 and one second lateral sealing member 220, but a pair of first lateral sealing members 210 may be installed in the development frame 201 so as to respectively contact both end portions of the developing roller 22 in the lengthwise direction of the developing roller 22. Also, a pair of the second lateral sealing members 220 respectively corresponding to the pair of the first lateral sealing members 210 may be installed in the development frame 201.

In the development frame 201, a lower attachment surface 231 to which the lower sealing member 29 is attached is provided. The development frame 201 includes a first mounting surface 232 and a second mounting surface 233. The first lateral sealing member 210 is attached to the first mounting surface 232. The first mounting surface 232 may have a curved portion so that the first lateral sealing member 210 has curvature as illustrated in FIG. 9 when the first lateral sealing member 210 is attached to the first mounting surface 232. The second lateral sealing member 220 is installed on the second mounting surface 233. The first mounting surface 232 and the second mounting surface 233 each have concave steps from the lower attachment surface 231. Thus, the first and second lateral sealing members 210 and 220 are respectively installed on the first and second mounting surfaces 232 and 233, and when the lower sealing member 29 is attached to the lower attachment surface 231, the lower sealing member 29 partially presses the first and second lateral sealing members 210 and 220 downwards.

The second lateral sealing member 220 may prevent the toner from leaking through a crack formed between a side wall 234 and an end portion 211 of the first lateral sealing member 210 that faces the side wall 234, the side wall 234 forming a boundary between the lower attachment surface 231 and the first mounting surface 232. The side wall 234 forms a boundary of one side of the first mounting surface 232, e.g., a downstream side of the first mounting surface 232, with respect to the rotation direction of the developing roller 22, thus extending in the lengthwise direction of the developing roller 22. With respect to the rotation direction of the developing roller 22, the regulator 28 is on the upstream side of the developing roller 22, and the lower sealing member 29 is on the downstream side thereof.

A side wall 235 between the second mounting surface 233 and the lower attachment surface 231 is closer to the lower attachment surface 231 than the side wall 234. The second lateral sealing member 220 includes a first portion 221 and a second portion 222. The first portion 221 is located inside the first lateral sealing member 210 and contacts an inner portion 212 adjacent to the end portion 211 of the first lateral sealing member 210, and the second portion 222 extends outside from the first portion 221 in the lengthwise direction of the developing roller 22. The second portion 222 extends along the end portion 211 of the first lateral sealing member 210 around the lower sealing member 29 and contacts the end portion 211. Thus, the second lateral sealing member 220 has an "L" shape overall and surrounds an outward portion of the end portion 211.

The second portion 222 may include a third portion 223 protruding towards the end portion 211 of the first lateral sealing member 210. The second lateral sealing member 220 is installed on the second mounting surface 233 in such a manner that the third portion 223 contacts the end portion 211 of the first lateral sealing member 210 and then is pressed.

As an example, the second lateral sealing member 220 may be attached to the second mounting surface 233. In this case, at least the third portion 223 is not attached to the second mounting surface 233 in order to allow the third portion 223 to be pressed.

As an example, the second lateral sealing member 220 may be pressed onto the second mounting surface 233. For example, a size of the second lateral sealing member 220 may be slightly, e.g., about 0.3 mm, greater than that of the second mounting surface 233. The second lateral sealing member 220 may include an elastic material. For example, the second lateral sealing member 220 may include a sponge. A shore 00 hardness of the second lateral sealing member 220 may be, for example, 28 or greater.

After the second lateral sealing member 220 having the above size is pressed onto the second mounting surface 233 and then the lower sealing member 29 is attached to the lower attachment surface 231, the second lateral sealing member 220 may be mounted on the second mounting surface 233.

The second lateral sealing member 220 including the first portion 221 and the second portion 222 has an "L" shape overall and has a shape surrounding an outward portion of the end portion 211 of the first lateral sealing member 210. Thus, the leakage of the toner through the crack between the side wall 234 and the end portion 211 of the first lateral sealing member 210 may be effectively addressed.

According to the second lateral sealing member 220 further including the third portion 223, the third portion 223 is pressed by the end portion 211 of the first lateral sealing member 210 and then compressed. Also, the second portion 222 of the second lateral sealing member 220 is pressed by the side wall 235 and contacts the same. Therefore, the leakage of the toner through the crack between the side wall 234 and the end portion 211 of the first lateral sealing member 210 may be effectively addressed.

FIGS. 8 and 9 illustrate the third portion 223 having a triangle shape, but the shape of the third portion 223 is not limited thereto. The shape of the third portion 223 may be a rectangle, a semicircle, or the like. In addition, there may be at least two third portions 223.

Referring again to FIGS. 2 and 8, the development frame 201 may include an upper frame 208 and a lower frame 209. The upper frame 208 forms upper walls and side walls of the developing portion 202 and the toner container 203, and the lower frame 209 forms lower walls of the developing portion 202 and the toner container 203. The upper frame 208 and the lower frame 209 may be coupled to each other by a coupling method such as ultrasonic welding or vibration welding. In this case, the first mounting surface 232 may be divided into a first portion 232-1 on the upper frame 208 and a second portion 232-2 on the lower frame 209. The first portion 232-1 and the second portion 232-2 are separated from each other by a boundary 207 between the upper frame 208 and the lower frame 209. The lower attachment surface 231 and the second mounting surface 233 are on the lower frame 209. That is, at least a portion of the first mounting surface 232 and the lower attachment surface 231 are on the lower frame 209. The second portion 232-2 and the second mounting surface 233 may be the same surface. By doing so, a step between the first and second lateral sealing members 210 and 220 may be removed, and thus stable sealing performance may be obtained. The description that the second portion 232-2 and the second mounting surface 233 are the same surface is not limited to a case where the second portion 232-2 and the second mounting surface 233 are the same plane, and may include a case where they form a single curved surface having no step.

When the boundary 207 is set in such a manner that the first mounting surface 232 is on the upper frame 208 overall, the contact state of the first lateral sealing member 210 and the lower sealing member 29 may differ, depending on the attachment state of the upper frame 208 and the lower frame 209.

FIGS. 10*a* and 10*b* are diagrams illustrating contact states of a lower sealing member and a first lateral sealing member according to a coupling state of an upper frame and a lower frame, according to an example.

Referring to FIGS. 10*a* and 10*b*, when the upper frame 208 is coupled to the lower frame 209, if a welding amount is insufficient, the upper frame 208 may protrude upwards in a thickness direction of the first lateral sealing member 210.

Then, as illustrated in FIG. 10*a*, a degree in which the lower sealing member 29 overlaps the first lateral sealing member 210 becomes excessive, and the lower sealing member 29 moves upwards such that a gap may be generated between the lower sealing member 29 and the first lateral sealing member 210. On the contrary, when the upper frame 208 is coupled to the lower frame 209, if a welding amount is excessive, the upper frame 208 moves downwards in a thickness direction of the first lateral sealing member 210. Then, a degree in which the lower sealing member 29 overlaps the first lateral sealing member 210 becomes too small, and thus the lower sealing member 29 may not stably contact the first lateral sealing member 210. Even in some cases, as illustrated in FIG. 10*b*, a gap may be generated between the lower sealing member 29 and the first lateral sealing member 210

FIG. 11 is a diagram illustrating a contact state of a lower sealing member and a first lateral sealing member according to an example.

Referring to FIG. 11, the first mounting surface 232 is formed over the upper frame 208 and the lower frame 209. That is, the boundary 207 is determined in such a manner that the second portion 232-2 of the first mounting surface 232 is on the lower frame 209. A step difference between the second portion 232-2 and the lower attachment surface 231 is not greatly affected by a change in the welding amount of the upper frame 208 and the lower frame 209. Thus, although the coupling state of the upper frame 208 and the lower frame 209, that is, the welding amount of the upper frame 208 and the lower frame 209, changes, the step difference between the second portion 232-2 and the lower attachment surface 231 is uniform, and the lower sealing member 29 stably contacts the first lateral sealing member 210 such that no gap is generated therebetween. In order to prevent the toner from leaking through the boundary 207, a boundary sealing member 230 may be provided on the boundary 207. For example, the boundary sealing member 230 may be attached to a surface of the upper frame 208 or the lower frame 209 that forms the boundary 207. The boundary sealing member 230 may include an elastic material, for example, a sponge. An end portion of the boundary sealing member 230 around the first mounting surface 232 may have the same height as the first mounting surface 232 or may slightly protrude therefrom. When the first lateral sealing member 210 is mounted on the first mounting surface 232, the first lateral sealing member 210 having elasticity is pressed by the boundary sealing member 230, and thus a step between the first mounting surface 232 and the boundary sealing member 230 may be compensated for.

FIG. 12 is a side view of a first lateral sealing member according to an example.

Referring to FIG. 12, the first lateral sealing member 210 includes a first surface 210*a* contacting the developing roller 22, and a second surface 210*b* opposite to the first surface 210*a*. The first surface 210*a* is concavely bent when the first lateral sealing member 210 is attached to the development frame 201, and in this case, the first surface 210*a* is pressed and the second surface 210*b* is stretched with respect to a neutral surface in the thickness direction. When the second surface 210*b* is not naturally stretched, the first surface 210*a* may have wrinkles, and thus a gap may be generated between the first surface 210*a* and the surface of the developing roller 22. According to the first lateral sealing member 210 of the present example, the second surface 210*b* includes slits (e.g., cutting scars) 219. Based on this configuration, when the first lateral sealing member 210 is bent, the second surface 210*b* elongates as the slits 219 have gaps therebetween, and thus the first surface 210*a* may not have wrinkles.

FIG. 13 is a cross-sectional view of a first lateral sealing member according to an example.

Referring to FIG. 13, the first lateral sealing member 210 includes a body 210*c* having elasticity and a double-sided tape layer 210-4 for attaching the body 210*c* to the first mounting surface 232. The body 210*c* may include a contact layer 210-1 contacting the outer circumferential surface of the developing roller 22, and an elastic layer 210-2. The contact layer 210-1 reduces friction with the outer circumferential surface of the developing roller 22 and may be, e.g., a felt layer. The elastic layer 210-2 includes an elastic material such as a sponge and applies elasticity to the first lateral sealing member 210. The contact layer 210-1 and the elastic layer 210-2 may be attached to each other by, e.g., the double-sided tape layer 210-3. The double-sided tape layer 210-4 at a lowermost level of the first lateral sealing member 210 is used to attach the first lateral sealing member 210 to the first mounting surface 232. The double-sided tape layer 210-4 may include a non-woven fabric layer 210-4*b* and first and second adhesive layers 210-4*a* and 210-4*c* that are respectively formed on both surfaces of the non-woven fabric layer 210-4*b*.

The elastic layer 210-2 needs to be stretched when the first lateral sealing member 210 is attached to the development frame 201. However, since the double-sided tape layer 210-4 is attached to the elastic layer 210-2, the elastic layer 210-2 may not be well stretched. In other words, since the non-woven fabric layer 210-4*b* of the double-sided tape layer 210-4 is not stretched, the elastic layer 210-2 may not be stretched as well. Then, the first surface 210*a* may be wrinkled. In consideration of the above features, slits (e.g., cutting scars) 219 are formed from the second surface 210*b* to the double-sided tape layer 210-4. Since the non-woven fabric layer 210-4*b* is cut due to the slits 219, the elastic layer 210-2 may be easily stretched, and the first lateral sealing member 210 may be easily bent. Ideally, the elastic layer 210-2 is uniformly stretched overall on a region where the slits 219 are formed, but actually, the elastic layer 210-2 may be locally stretched in a region where the first lateral sealing member 210 is bent. Then, the elastic layer 210-2 may be torn, and the toner may leak through the torn portion of the elastic layer 210-2. When a high-density closed cell sponge is used as the elastic layer 210-2, a hardness of the first lateral sealing member 210 is high, and thus contact pressure with the developing roller 22 may increase. In this case, the toner that is input between the first surface 210*a* and the surface of the developing roller 22 is melted by frictional heat and solidified again, the toner may adhere to the outer circumferential surface of the developing roller 22 again. The re-adhesion of the toner may cause an increase in rotation load of the developing roller 22, damage to the first surface 210*a* of the first lateral sealing member 210, and toner leakage resulting from the damage. When a low-density closed cell sponge is used as the elastic layer 210-2, a risk of damage to the elastic layer 210-2 increases.

According to the present example, a support layer 210-5 having ductility is interposed between the elastic layer 210-2 and the double-sided tape layer 210-4. The support layer 210-5 may be, for example, an adhesive layer. The support layer 210-5 may be provided by a double-sided tape having no non-woven fabric layer 210-4*b*. The ductility of the support layer 210-5 does not affect the stretching of the elastic layer 210-2. Therefore, the elastic layer 210-2 may be easily stretched, and the first lateral sealing member 210 may be easily bent. In addition, the support layer 210-5 supports the elastic layer 210-2 to prevent damage to the elastic layer 210-2.

It should be understood that examples described herein should be considered in a descriptive sense only and not for purposes of limitation. Descriptions of features or aspects within each example should typically be considered as available for other similar features or aspects in other examples.

While one or more examples have been described with reference to the figures, it will be understood by those of ordinary skill in the art that various changes in form and details may be made therein without departing from the spirit and scope of the inventive concept as defined by the following claims.

The invention claimed is:

1. A development cartridge detachable from a main body of an image forming apparatus, the development cartridge comprising:

a photosensitive drum on which an electrostatic latent image is formed;

a cleaning member to remove a waste toner from a surface of the photosensitive drum;

a lateral waste toner sealing member contacting an end portion of the photosensitive drum in a lengthwise direction of the photosensitive drum, to prevent the waste toner from leaking through the end portion of the photosensitive drum; and a photosensitive frame comprising:

a waste toner container to contain the waste toner;

a first attachment surface to which the lateral waste toner sealing member is attached; and a side wall to form an upstream side boundary of the first attachment surface with respect to a rotation direction of the photosensitive drum, wherein the lateral waste toner sealing member comprises an opposite surface facing the side wall, and wherein a protrusion protruding towards the side wall is provided on the opposite surface.

2. The development cartridge of claim 1, wherein an adhesive layer is provided on a portion of a bottom surface of the lateral waste toner sealing member, except for a portion corresponding to the protrusion.

3. The development cartridge of claim 2, wherein the lateral waste toner sealing member includes an elastic layer, and wherein a felt layer is provided on a top surface of the lateral waste toner sealing member.

4. The development cartridge of claim 1, wherein a connection portion to connect the side wall to the first attachment surface is provided on an edge portion where the side wall contacts the first attachment surface.

5. The development cartridge of claim 1, further comprising a lower waste toner sealing member located on an upstream side of the cleaning member with respect to the rotation direction of the photosensitive drum, attached to the photosensitive frame, contacting the surface of the photosensitive drum, and sealing the waste toner container together with the cleaning member and the lateral waste toner sealing member.

6. The development cartridge of claim 5, wherein the photosensitive frame comprises a second attachment surface to which the lower waste toner sealing member is attached, wherein the first attachment surface has a concave step from the second attachment surface, and wherein the side wall forms a boundary between the first attachment surface and the second attachment surface.

7. The development cartridge of claim 1, wherein a shape of the protrusion includes a triangle shape, a rectangular shape, or an oval shape.

8. The development cartridge of claim 1, wherein the protrusion protrudes 1.5 mm or less from the opposite surface.

9. The development cartridge of claim 1, wherein two or more protrusions protruding towards the side wall are provided on the opposite surface.

10. The development cartridge of claim 1, further comprising a pair of lateral waste toner sealing members contacting each end portion of the photosensitive drum in the lengthwise direction of the photosensitive drum.

* * * * *